US008234990B2

(12) United States Patent
Xie et al.

(10) Patent No.: US 8,234,990 B2
(45) Date of Patent: Aug. 7, 2012

(54) METHODS FOR IMPROVING CONFORMABILITY OF NON-CRIMP FABRIC AND CONTOURED COMPOSITE COMPONENTS MADE USING SUCH METHODS

(75) Inventors: Ming Xie, Beavercreek, OH (US); Brian Stephens, Cincinnati, OH (US); Johnny Ray Gentry, Bellbrook, OH (US); Elliott Schulte, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 1011 days.

(21) Appl. No.: 12/183,187

(22) Filed: Jul. 31, 2008

(65) Prior Publication Data

US 2010/0024179 A1 Feb. 4, 2010

(51) Int. Cl.

| | |
|---|---|
| ***D05B 23/00*** | (2006.01) |
| ***B32B 3/06*** | (2006.01) |
| *D04H 13/00* | (2006.01) |

(52) U.S. Cl. ..... 112/475.17; 112/475.08; 112/415; 428/102; 28/140

(58) Field of Classification Search ..... 112/475.01–475.09, 475.15, 475.17, 413, 415; 66/82 S, 66/192, 170, 190; 428/98–113, 221; 28/140, 28/143, 164, 165; 264/292, 324; 442/183, 442/189, 226, 350

See application file for complete search history.

(56) References Cited

U.S. PATENT DOCUMENTS

| | | | | |
|---|---|---|---|---|
| 4,949,761 | A | 8/1990 | Fleury et al. | |
| 5,187,952 | A * | 2/1993 | Zafiroglu | 66/192 |
| 5,333,568 | A | 8/1994 | Meldner et al. | |
| 5,546,880 | A * | 8/1996 | Ronyak et al. | 112/475.01 |
| 5,809,805 | A * | 9/1998 | Palmer et al. | 66/84 A |
| 6,843,194 | B1 | 1/2005 | Baudet | |
| 7,192,634 | B2 * | 3/2007 | Carter et al. | 428/113 |
| 2004/0113317 | A1 | 6/2004 | Healy et al. | |
| 2011/0046715 | A1 * | 2/2011 | Ugbolue et al. | 623/1.15 |

FOREIGN PATENT DOCUMENTS

| | | | |
|---|---|---|---|
| DE | 3822188 | A1 | 1/1990 |
| DE | 19913647 | A1 | 9/2000 |
| DE | 10005202 | A1 | 11/2000 |
| DE | 10252671 | C1 | 12/2003 |
| WO | 98/10128 | A | 3/1998 |
| WO | 03/041948 | A | 5/2003 |

OTHER PUBLICATIONS

PCT/US2009/049482, Search Report and Written Opinion, Oct. 30, 2009.

PCT/US2009/049468, Search Report and Written Opinion, Oct. 30, 2009.

* cited by examiner

*Primary Examiner* — Ismael Izaguirre

(74) *Attorney, Agent, or Firm* — William Scott Andes; Gary M. Hartman; Domenica N. S. Hartman

(57) ABSTRACT

Methods for making a self-conforming non-crimp fabric involving tailoring at least a first parameter to anchor the fabric and at least a second parameter to provide conformability of the fabric, the first and second parameters selected from stitch type, stitch spacing, stitch density, stitch material, stitch weight, stitch tension, and combinations of the same.

24 Claims, 3 Drawing Sheets

METHODS FOR IMPROVING CONFORMABILITY OF NON-CRIMP FABRIC AND CONTOURED COMPOSITE COMPONENTS MADE USING SUCH METHODS

TECHNICAL FIELD

Embodiments described herein generally relate to methods for improving the conformability of non-crimp fabric, and contoured composite components made using such methods. More particularly, embodiments herein generally describe methods for making a self-conforming non-crimp fabric comprising tailoring at least a first parameter to anchor the fabric and at least a second parameter to provide conformability of the fabric, the first and second parameters selected from the group consisting of stitch type, stitch spacing, stitch density, stitch material, stitch weight, stitch tension, and combinations thereof.

BACKGROUND OF THE INVENTION

In recent years composite materials have become increasingly popular for use in a variety of aerospace applications because of their durability and relative light weight. Several fiber fabric preforms can be used in composite manufacturing, such as woven fabric, braided fabric, and non-crimp fabric. The use of these fiber fabric preforms can allow for automation in the manufacturing process, and can provide a lower-cost and more robust fabrication method for composite components than existed previously.

Of the fiber fabric preforms, woven fabric is generally the most widely used and least expensive. The fibers of woven fabrics typically display a perpendicular (0° and 90°) orientation that has to be cut and rotated if the fibers need to be placed at any bias angles for manufacturing purposes. This disadvantage often results in increased material waste and reduction in the automation of the component fabrication process. Compared to woven fabric, braided fabrics can allow for more design flexibility because the fibers can be oriented at bias angles. However, braided fabric is generally more difficult to produce, and therefore, more expensive than woven fabric. Moreover, braided fabrics having the fibers at bias angles can support only a defined maximum amount of applied tension during component fabrication beyond which the fiber architecture of the material will undesirably distort.

In an effort to address some of the foregoing issues, multiaxial non-crimp fabric (NCF) has recently started being used to make composite components. As used herein, NCF refers to any fabric preform that can be made by stacking one or more layers of unidirectional fibers and then stitching the layers together. The stitching yarns serve as a manufacturing aid that hold the layers together and allow for handling of the fabric. The yarns are consistent throughout the fabric and are not used for structural function.

NCF can be less costly than woven fabrics because there is less material waste and automation can be used to accelerate the component fabrication process. Additionally, because of the lack of interweaving fibers and inherent efficiency in the fabrication process, NCF can be less costly to make than braided fabric. However, compared to weaves and braids, which can be manufactured to have a built-in contoured shape using a specially designed fabric take-up mandrel, NCF generally needs to be produced as a flat sheet or roll. Because of this, the conformability of NCF is generally not as good as that achieved using braids or weaves, and therefore, can be more difficult to conform to a contoured geometry without developing wrinkles.

Accordingly, there remains a need for methods for making non-crimp fabric having improved conformability and contoured components made using such methods.

BRIEF DESCRIPTION OF THE INVENTION

Embodiments herein generally relate to methods for making a self-conforming non-crimp fabric comprising tailoring at least a first parameter to anchor the fabric and at least a second parameter to provide conformability of the fabric, the first and second parameters selected from the group consisting of stitch type, stitch spacing, stitch density, stitch material, stitch weight, stitch tension, and combinations thereof.

Embodiments herein also generally relate to methods for making a self-conforming non-crimp fabric comprising tailoring at least one of a first parameter to anchor the fabric and at least one of a second parameter to provide conformability of the fabric wherein the first parameter is selected from the group consisting of a simple stitch type, smaller stitch spacing, high stitch density, rigid stitch material, heavy stitch weight, taut stitch tension, and combinations thereof, and the second parameter is selected from the group consisting of a complex stitch type, larger stitch spacing, low stitch density, elastic stitch material, light stitch weight, slack stitch tension, and combinations thereof wherein the non-crimp fabric comprises fibers selected from the group consisting of carbon fibers, graphite fibers, glass fibers, ceramic fibers, aromatic polyamide fibers, and combinations thereof.

These and other features, aspects and advantages will become evident to those skilled in the art from the following disclosure.

BRIEF DESCRIPTION OF THE DRAWINGS

While the specification concludes with claims particularly pointing out and distinctly claiming the invention, it is believed that the embodiments set forth herein will be better understood from the following description in conjunction with the accompanying figures, in which like reference numerals identify like elements.

DETAILED DESCRIPTION OF THE INVENTION

Embodiments described herein generally relate to methods for making a self-conforming non-crimp fabric comprising tailoring at least a first parameter to anchor the fabric and at least a second parameter to provide conformability of the fabric, the first and second parameters selected from the group consisting of stitch type, stitch spacing, stitch density, stitch material, stitch weight, stitch tension, and combinations thereof. While certain embodiments herein may generally focus on methods for making composite casings, it will be understood by those skilled in the art that the description should not be limited to such. Indeed, as the following description explains, the methods described herein may be used to make any composite component having at least one contoured shape or surface, such as any component having an airfoil-shaped structure, as described herein below.

To make the components described herein, at least one ply of a fabric can be applied to a tool having a contoured shape, which may then be treated with a resin and cured, as set forth herein below. As used herein, "tool" may refer to any mandrel or mold capable of use in making a composite component. The fabric may be applied continuously or placed piece by piece about the tool until achieving the desired number of layers.

Initially, at least one ply of fabric can be applied to the tool. As used herein throughout, "contour(ed)" means a component having a portion of which comprises a non-planar (i.e. not flat) shape or surface. Some examples of contoured shapes include, but should not be limited to cylinders, cones, and combinations thereof.

Figure 1:
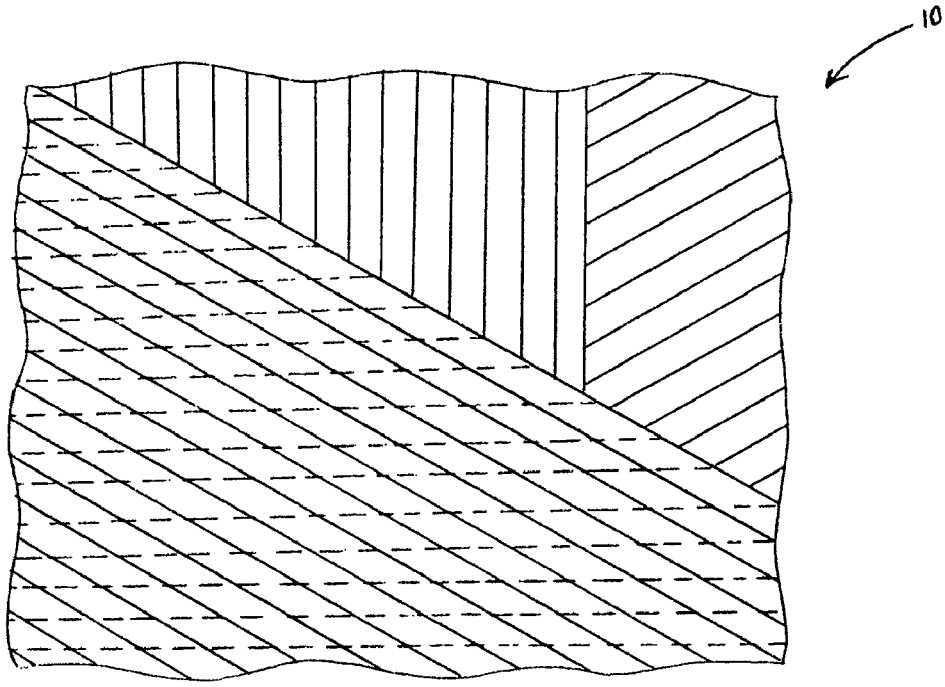
FIG. 1 is a schematic cut away view of one embodiment of a ply of non-crimp fabric having three unidirectional layers of fibers in accordance with the description herein.

The ply of fabric may comprise a self-conforming non-crimp fabric. As used herein, "non-crimp fabric" 10 refers to any fabric that is formed by stacking one or more layers of unidirectional fibers and then stitching the layers together, as shown generally in FIG. 1. The unidirectional fibers of non-crimp fabric may be oriented in a variety of ways to satisfy design requirements. Those skilled in the art will understand that because the non-crimp fabric is formed by stitching together layers of unidirectional fibers, the unidirectional fibers may have virtually any angle of orientation desired. Regardless of the particular orientation of the fibers of the fabric, in general, the fibers may comprise any suitable reinforcing fiber known to those skilled in the art capable of being combined with a resin to produce a composite. In one embodiment, the fibers may comprise at least one of carbon fibers, graphite fibers, glass fibers, ceramic fibers, and aromatic polyamide fibers.

Figure 2:
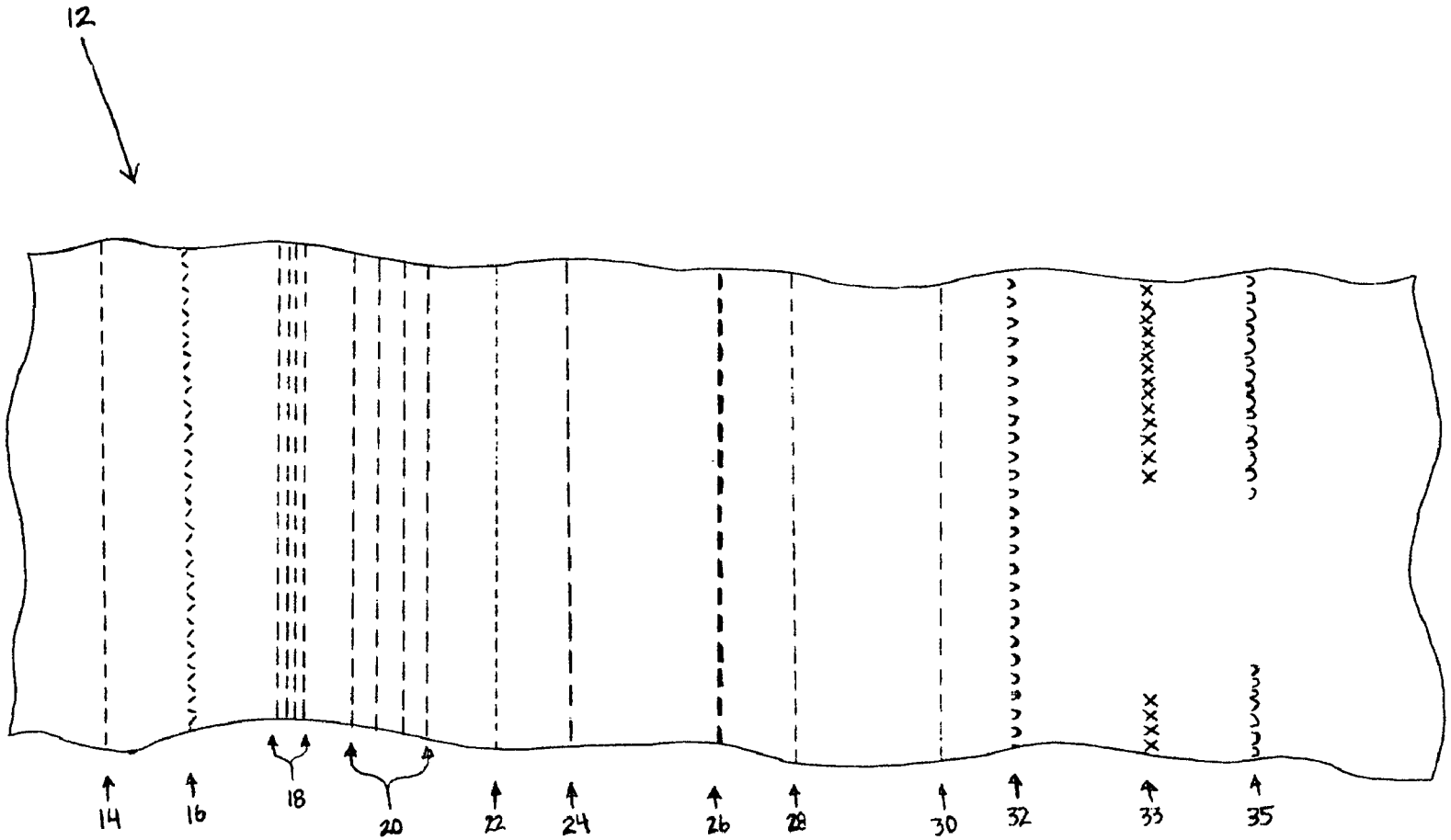
FIG. 2 is a schematic representation of one embodiment of a ply of self-conforming non-crimp fabric having tailorable parameters in accordance with the description herein.

To address the previously discussed deficiencies with current composite technologies, described herein below are methods for making self-conforming non-crimp fabric 12, as shown in FIG. 2. "Self-conforming" refers to the ability of the fabric to take the shape of the tool to which it is applied without forming wrinkles when such tool has a contoured shape, as defined herein. Such methods generally comprise tailoring at least a first parameter to anchor the fabric and at least a second parameter to provide conformability of the fabric, the first and second parameters selected from the group consisting of stitch type, stitch spacing, stitch density, stitch material, stitch weight, stitch tension, and combinations thereof. By tailoring such parameters, the non-crimp fabric can be designed to display improved conformability to the tool to which it is applied.

In particular, tailoring the previously referenced parameters can provide for anchoring, or improving conformability, of the fabric depending on design needs. As used herein, "anchor(ing)" the fabric means lessening the movement of the fabric to hold it in place, or increase handling capability. For example, it may be desirable to anchor the fabric at a concave point to hold it in place or along the edges to increase handling capability. Providing "conformability" means allowing the fibers of the fabric to move to fit the contour of the tool to which it is applied without wrinkling.

As shown generally in FIG. 2, tailoring the stitch type can involve utilizing a simple stitch type 14 to anchor the fabric and a complex stitch type 16 to provide conformability of the fabric. "Simple stitch type" 14 refers to a straight stitch, while "complex stitch type" 16 can refer to a more complicated stitch such as a cross stitching pattern or a zig-zag pattern.

Tailoring stitch spacing can involve utilizing a smaller stitch spacing 18 to anchor the fabric and a larger stitch spacing 20 to provide conformability of the fabric. "Smaller stitch spacing" 18 can include stitch spacing of from about 10 ppi to about 2.5 ppi. "Larger stitch spacing" 20 can include stitch spacing of from about 2.49 ppi to about 0.1 ppi.

Tailoring stitch density involves utilizing high stitch density 22 to anchor the fabric and low stitch density 24 to provide conformability of the fabric. "High stitch density" 22 can include stitches having a density of from about 10 stitches/1 inch (about 10 stitches/2.54 cm) to about 5 stitches/1 inch (about 5 stitches/2.54 cm) while "low stitch density" 24 can include stitches having a density of from about 4.9 stitches/1 inch (about 4.9 stitches/2.54 cm) to about 1 stitch/1 inch (about 1 stitch/2.54 cm). Such differences in density can be achieved by, for example, running the non-crimp fabric through a stitching machine multiple times until the desired density is attained.

In one embodiment, tailoring stitch material involves utilizing a rigid stitch material to anchor the fabric and an elastic stitch material to provide conformability of the fabric. Some examples of rigid stitch material can include, but should not be limited to, standard nylon filaments, while elastic stitch material may include, but should not be limited to, thermoplastic elastomers.

Tailoring stitch weight can involve utilizing a heavy stitch weight 26 to anchor the fabric and a light stitch weight 28 to provide conformability of the fabric through controlled stitch breakage. "Heavy stitch weight" 26 may include, but should not be limited to, a stitch weight of 72 denier or greater while "light stitch weight" 28 may include, but should not be limited to, a stitch weight of less than 72 denier.

Tailoring stitch tension can involve utilizing a taut stitch tension 30 to anchor the fabric and a slack stitch tension 32 to provide conformability of the fabric using local fabric translation. By "taut stitch tension" 30 it is meant that the stitch is under tension, i.e. that the stitch is stretched tight against the fabric. "Slack stitch tension" 32 refers to a stitch constructed with low tension that is loose against the fabric until the fabric is applied to the tool. Once applied to the tool, the slack stitch can be pulled tighter, thereby allowing the self-conforming non-crimp fabric to conform to the contour of the tool without wrinkles.

In addition, conformability may also be provided by interrupting the stitching of any of the previously described tailorable parameters. "Interrupting" the stitch refers to removing at least one stitch in the stitch line. Those skilled in the art will understand that more than one stitch can be removed, and that the stitches removed may be adjacent, alternating, every third stitch, fourth stitch, etc., or any combination thereof. For example, in one embodiment, a cross-stitching pattern may be made more conformable by interrupting the stitching 33 by removing a section of stitches as shown generally in FIG. 2. In another embodiment, a slack stitch tension may be made even more conformable by interrupting the stitching 35.

Figure 3:
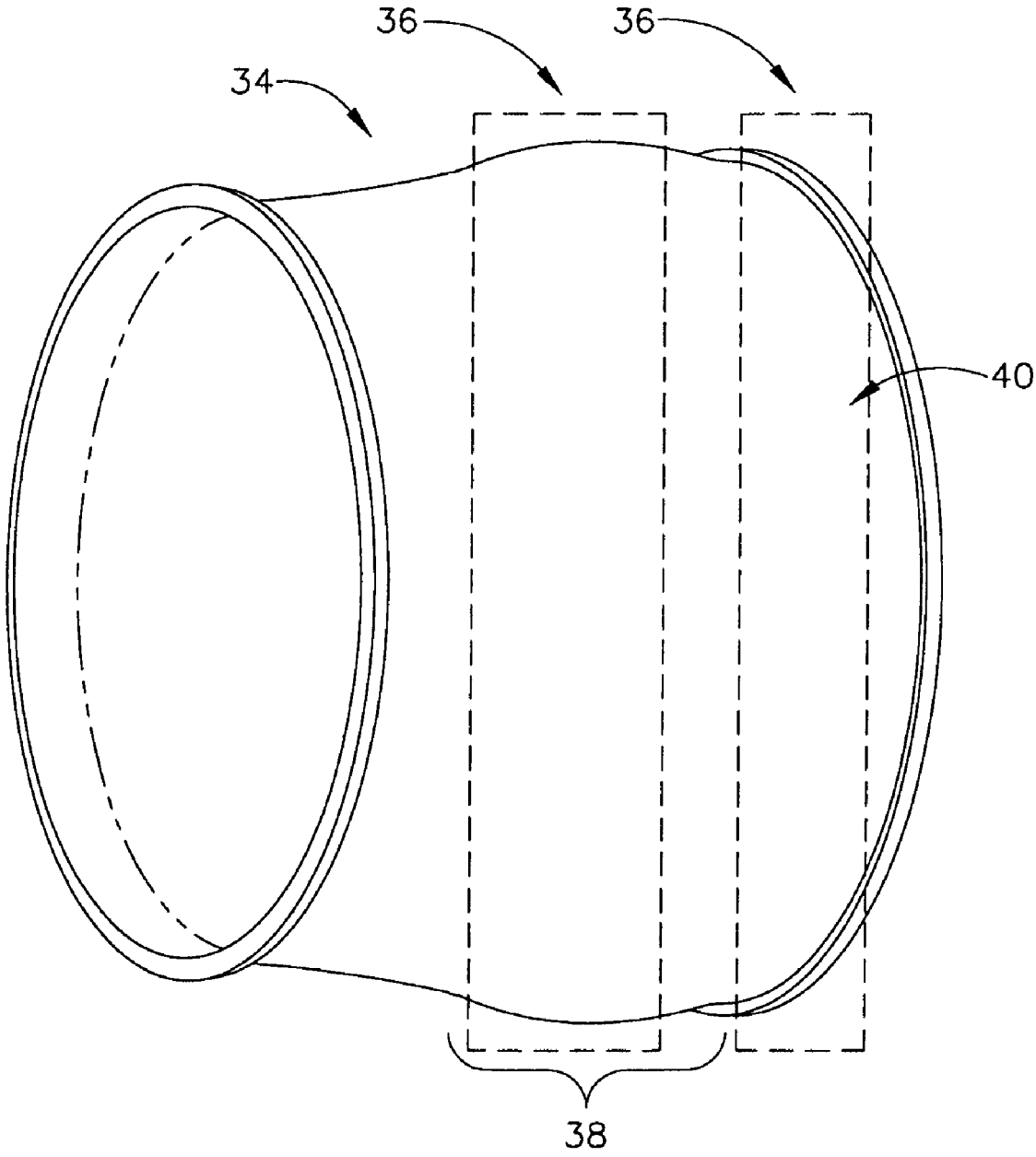
FIG. 3 is a schematic perspective view of one embodiment of a composite component having a contoured shape in accordance with the description herein.

As previously described, the parameters herein can be tailored to make a self-conforming non-crimp fabric that can be used to make a composite component 34 having a contour as shown generally in FIG. 3. Composite component 34 can comprise at least one region 36 including the one or more tailored parameters described herein. Such region 36 may comprise either a conforming region 38 or an anchored region 40. Composite component 34 may comprise a contour including, but not be limited to, cylindrical shapes or surfaces, conical shapes or surfaces, and combinations thereof. Those skilled in the art will understand that the component need not be completely contoured but rather, the component may have only a contoured portion. In one embodiment, the composite component may comprise a composite containment casing, such as a fan casing. In another embodiment, the component may comprise an airfoil-shaped structure, such as, but not limited to, fan blades on a jet engine or wind blades on a windmill.

After the self-conforming non-crimp fabric has been applied to the tool as desired, the resulting composite component preform can be treated with a resin and cured using conventional techniques and methods known to those skilled in the art to produce the composite component having a contour.

Constructing a composite component, and in particular a casing or airfoil-shaped structure, using the previously described fabrics and methods can offer benefits over current non-crimp fabric technology. The ability to tailor the non-crimp fabric as described herein can allow the fabric to display improved conformability to the tool to which it is applied. As a result, the bulk of the resulting preform can be reduced, which can ensure a higher fabric fiber volume and can reduce the occurrence of wrinkles in the finished cured composite component.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

forming a self-conforming non-crimp fabric comprising layers of unidirectional fibers and stitching by tailoring at least a first parameter of the stitching to anchor the fabric and at least a second parameter of the stitching to provide conformability of the fabric, the first and second parameters selected from the group consisting of stitch type, stitch spacing, stitch density, stitch material, stitch weight, stitch tension, and combinations thereof;

infusing the fabric with a resin; and then curing the resin to form a component containing the layers and the stitching, the component comprising an anchoring region including the stitching tailored by the first parameter and a conforming region including the stitching tailored by the second parameter.

2. The method of claim 1 wherein the non-crimp fabric comprises fibers selected from the group consisting of carbon fibers, graphite fibers, glass fibers, ceramic fibers, aromatic polyamide fibers, and combinations thereof.

3. The method of claim 1, wherein the tailoring of the first and second parameters comprises tailoring the first parameter to utilize a simple stitch type to anchor the fabric, or tailoring the second parameter to utilize a complex stitch type to provide conformability of the fabric, or a combination thereof.

4. The method of claim 1, wherein the tailoring of the first and second parameters comprises tailoring the first parameter to utilize a smaller stitch spacing to anchor the fabric, or tailoring the second parameter to utilize a larger stitch spacing to provide conformability of the fabric, or a combination thereof.

5. The method of claim 4 wherein the smaller stitch spacing comprises a stitch spacing of about 10 ppi to about 2.5 ppi and the larger stitch spacing comprises stitch spacing of about 2.49 ppi to about 0.1 ppi.

6. The method of claim 1, wherein the tailoring of the first and second parameters comprises tailoring the first parameter to utilize a high stitch density to anchor the fabric, or tailoring the second parameter to utilize a low stitch density to provide conformability of the fabric, or a combination thereof.

7. The method of claim 6 wherein the high stitch density comprises stitches having a density of about 10 stitches/1 inch (about 10 stitches/2.54 cm) to about 5 stitches/1 inch (about 5 stitches/2.54 cm) and the low stitch density comprises stitches having a density of about 4.9 stitches/1 inch (about 4.9 stitches/2.54 cm) to about 1 stitch/1 inch (about 1 stitch/2.54 cm).

8. The method of claim 1, wherein the tailoring of the first and second parameters comprises tailoring the first parameter to utilize a rigid stitch material to anchor the fabric, or tailoring the second parameter to utilize an elastic stitch material to provide conformability of the fabric, or a combination thereof.

9. The method of claim 8 wherein the rigid stitch material comprises nylon filaments and the elastic stitch material comprises thermoplastic elastomers.

10. The method of claim 1, wherein the tailoring of the first and second parameters comprises tailoring the first parameter to utilize a heavy stitch weight to anchor the fabric, or tailoring the second parameter to utilize a light stitch weight to provide conformability of the fabric through controlled stitch breakage, or a combination thereof.

11. The method of claim 10 wherein the heavy stitch weight comprises a stitch weighing about 72 denier or greater and the light stitch weight comprises a stitch weighing less than about 72 denier.

12. The method of claim 1, wherein the tailoring of the first and second parameters comprises tailoring the first parameter to utilize a taut stitch tension to anchor the fabric, or tailoring the second parameter to utilize a slack stitch tension to provide conformability of the fabric, or a combination thereof.

13. The method of claim 1, comprising providing conformability of the fabric by interrupting the stitching of any of the first parameter, the second parameter, or a combination thereof.

14. The component made by the method of claim 1.

15. A method comprising:

forming a self-conforming non-crimp fabric comprising layers of unidirectional fibers and stitching by tailoring at least one of a first parameter of the stitching to anchor the fabric and at least one of a second parameter of the stitching to provide conformability of the fabric wherein the first parameter is at least one selected from the group consisting of a simple stitch type, smaller stitch spacing, high stitch density, rigid stitch material, heavy stitch weight, taut stitch tension, and combinations thereof, and the second parameter is at least one selected from the group consisting of a complex stitch type, larger stitch spacing, low stitch density, elastic stitch material, light stitch weight, slack stitch tension, and combinations thereof wherein the non-crimp fabric comprises fibers selected from the group consisting of carbon fibers, graphite fibers, glass fibers, ceramic fibers, aromatic polyamide fibers, and combinations thereof;

infusing the fabric with a resin; and then curing the resin to form a component containing the layers and the stitching, the component comprising an anchoring region including the stitching tailored by the first parameter and a conforming region including the stitching tailored by the second parameter.

16. The method of claim 15 wherein the first parameter comprises the smaller stitch spacing and stitch spacing of about 10 ppi to about 2.5 ppi and the second parameter comprises the larger stitch spacing and stitch spacing of about 2.49 ppi to about 0.1 ppi.

17. The method of claim 15, wherein the first parameter comprises the high stitch density and stitches having a density of about 10 stitches/1 inch (about 10 stitches/2.54 cm) to about 5 stitches/1 inch (about 5 stitches/2.54 cm) and the second parameter comprises the low stitch density and stitches having a density of about 4.9 stitches/1 inch (about 4.9 stitches/2.54 cm) to about 1 stitch/1 inch (about 1 stitch/2.54 cm).

18. The method of claim 15, wherein the first parameter comprises the heavy stitch weight and a stitch weighing about 72 denier or greater and the second parameter comprises the light stitch weight and a stitch weighing less than about 72 denier.

19. The method of claim 15, further comprising providing conformability of the fabric by interrupting the stitching of any of the first parameter, the second parameter, or a combination thereof.

20. The component made by the method of claim 15.

21. The composite component of claim 14, wherein the composite component is a contoured containment casing of an engine.

22. The composite component of claim 14, wherein the composite component is a fan blade of an engine or a wind blade of a windmill.

23. The composite component of claim 20, wherein the composite component is a contoured containment casing of an engine.

24. The composite component of claim 20, wherein the composite component is a fan blade of an engine or a wind blade of a windmill.

* * * * *